US005887553A

United States Patent [19]

Ballmann et al.

[11] Patent Number: 5,887,553

[45] Date of Patent: Mar. 30, 1999

[54] DEVICE FOR ELECTROMAGNETIC ACTUATION OF A GAS EXCHANGE VALVE

[75] Inventors: Rainer Ballmann, Fellbach; Christian Enderle, Baltmannsweiler; Paul Wurster, Neuhengstett, all of Germany

[73] Assignee: Daimler-Benz AG, Germany

[21] Appl. No.: 971,364

[22] Filed: Nov. 17, 1997

[30] Foreign Application Priority Data

Nov. 15, 1996 [DE] Germany ..... 196 47 305.5

[51] Int. Cl.[6] ..... F01L 9/04

[52] U.S. Cl. ..... 123/90.11; 251/129.01; 251/129.18

[58] Field of Search ..... 123/90.11; 251/129.01, 251/129.15, 129.16, 129.18

[56] References Cited

U.S. PATENT DOCUMENTS

| | | | |
|---|---|---|---|
| 5,117,213 | 5/1992 | Kreuter et al. | 123/90.11 |
| 5,131,624 | 7/1992 | Kreuter et al. | 251/129.18 |
| 5,636,601 | 6/1997 | Moriya et al. | 123/90.11 |
| 5,762,035 | 6/1998 | Schebitz | 123/90.11 |

FOREIGN PATENT DOCUMENTS

| | | |
|---|---|---|
| 43 36 287 C1 | 3/1995 | Germany . |
| 296 04 946 U1 | 8/1997 | Germany . |
| 2 137 420 A | 10/1984 | United Kingdom . |
| 2 312 244 A | 10/1997 | United Kingdom . |
| WO 95/00959 | 1/1995 | WIPO . |

*Primary Examiner*—Weilun Lo
*Attorney, Agent, or Firm*—Evenson, McKeown, Edwards & Lenahan, P.L.L.C.

[57] ABSTRACT

A device for electromagnetic actuation of a charge change valve for internal combustion engines has an actuator unit that cooperates with the charge change valve and is arranged in a cylinder head of the engine. The actuator has an armature and two switch magnets located on either side of the armature, with the switch magnets holding the charge change valve in an open or closed position. The actuator unit is mounted to float in the cylinder head, with a play-compensating device with a play-compensating piston having a first and second pressure chambers being provided on or in the side of the actuator unit facing away from the charge change valve. The first pressure chamber is controlled as a function of engine pressure and the second pressure chamber is connected by a check valve with the first pressure chamber. Pressure medium can be drained from the second pressure chamber through a throttle line between the play-compensating piston and a cylinder surrounding said piston.

13 Claims, 2 Drawing Sheets

DEVICE FOR ELECTROMAGNETIC ACTUATION OF A GAS EXCHANGE VALVE

BACKGROUND AND SUMMARY OF THE INVENTION

This application claims the priority of German patent application DE 196 47 305.5, the disclosure of which is expressly incorporated by reference herein.

The invention relates to an electromagnetic actuator for a charge change valve (poppet valve) for an internal combustion engine.

German patent document DE 43 36 287 C1 discloses a device for compensating for changes in length of the valve drive during operation. Clamping elements are used for this purpose. If clamping of the electromagnet (switch magnet) is triggered by the clamping elements when the valve is closed, the electromagnet (switch magnet) attracts accordingly by means of the armature. This ensures that the electromagnet (switch magnet) responsible for the closed position can be "adjusted," and that the armature always rests exactly on the surface or the pole area of the magnet body of the switch magnet.

The object of the present invention is to provide a device of this type which permits simple hydraulic length compensation in a valve drive during operation.

This object is achieved by the electromagnetic actuator according to the invention, which is float-mounted. This means that the complete actuator unit with the electromagnet, armature plate and other parts is mounted so that it can be displaced along the valve axis in the cylinder head. For this purpose, the actuator unit can consist of a preassembled component. By deliberately allowing an escape of the pressure medium (generally oil), all moving parts of the device are supplied with lubricating oil by means of a suitable channel guide.

The play-compensating piston compensates for both "positive" and "negative" valve play. "Negative" valve play means that the valve no longer closes properly. In this case, pressure medium is expelled from the second pressure chamber until the valve play is zero or until length compensation has been performed. Conversely, with "positive" play (play between the valve shaft and the actuating unit with the valve resting correctly on the valve seat), pressure medium is added to the first pressure chamber of the play-compensating piston until the play is again compensated, or until the valve shaft cooperates with the actuator unit with zero play.

Other objects, advantages and novel features of the present invention will become apparent from the following detailed description of the invention when considered in conjunction with the accompanying drawings.

DETAILED DESCRIPTION OF THE DRAWINGS

Figure 1:
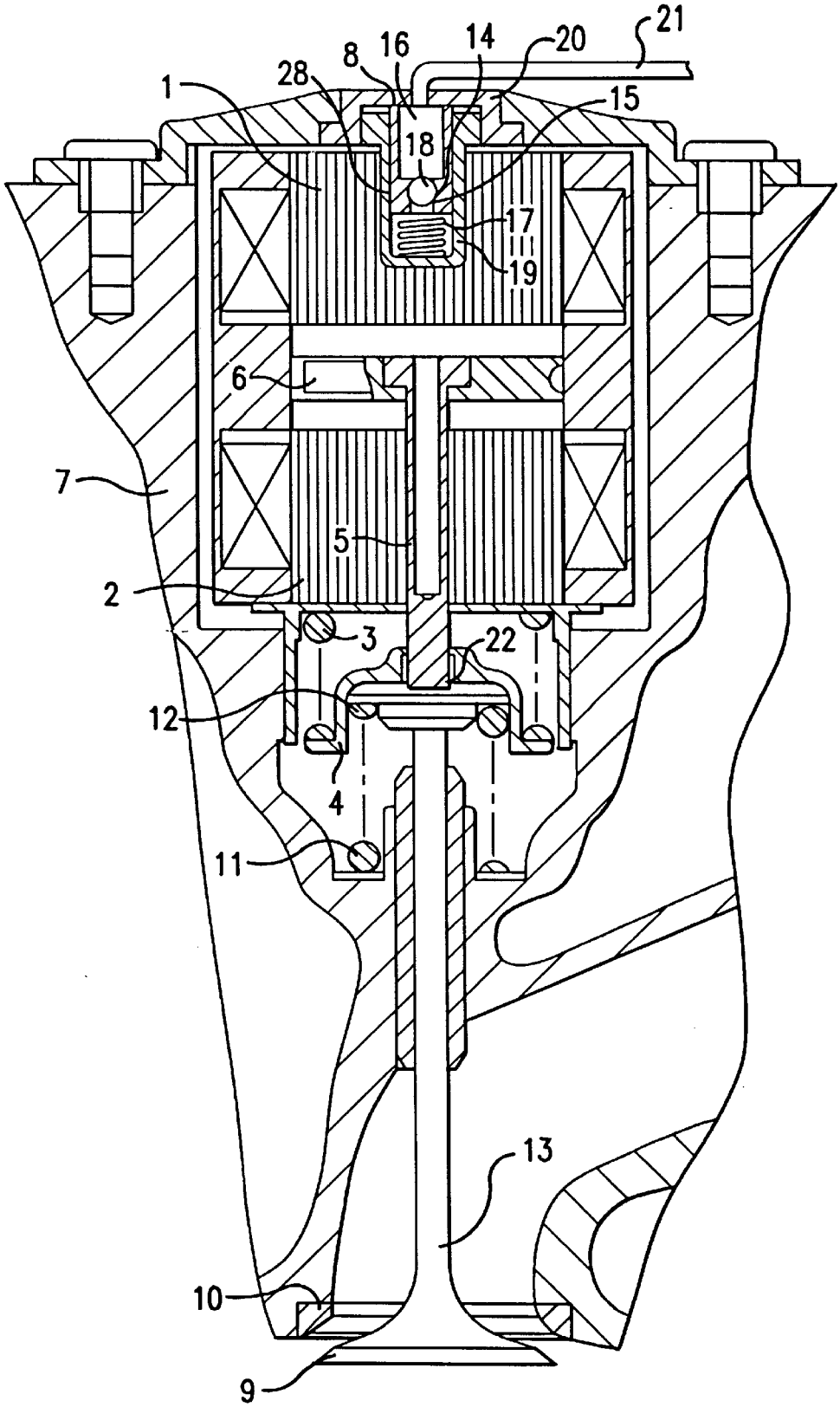
FIG. 1 is a lengthwise section through a first embodiment of the invention.

As shown in FIG. 1, an actuator unit has two electromagnets 1 and 2, an upper spring 3 abutting a spring plate 4, a guide pin 5, and an armature plate 6. The actuator unit is located in a cylinder head 7 and is installed so that it is displaceable or "floats" along the valve axis. In the case of rectangular actuators, the upper guide takes the form of a housing of a hydraulic play-compensating device 8 or an additional component. The lower guide is represented by a cylindrical part. In the case of pot magnets with a cylindrically shaped magnet, the housing of the actuator itself can be used as a guide. The actuator unit can be preassembled.

A valve 9, which abuts a valve seat ring 10 in the closed state, is also provided with a lower spring 11 that has one end abutting cylinder head 7 and the other end abutting a supporting plate 12, located at the rear end of a valve shaft 13 of valve 9. Valve shaft 13 is flush or coaxial with the guide pin 5, and ideally there should be no endwise play between the two parts.

Play-compensating device 8 has a play-compensating piston 14 as the central part and a surrounding cylinder 15. Play-compensating piston 14 has a first (upper) pressure chamber 16 and a second (lower) pressure chamber 17. A check valve 18 located between the two pressure chambers 16 and 17 is held in the closed position by a retaining spring 19, and opens in the direction of the second pressure chamber 17 if overpressure is present. A certain amount of desirable play is provided as throttle connection 28, between play-compensating piston 14 and cylinder 15, so that pressure medium can escape outward from second pressure chamber 17, in the form of a throttled pressure medium drain. As can be seen from the drawing, the pressure medium compressed in this fashion can escape deliberately through the gap between a sealing lid 20 and upper electromagnet 1, and between the actuator unit and cylinder head 7.

Play-compensating piston 14 is positioned centrally or coaxially with respect to the lengthwise axis of the valve in or outside upper electromagnet 1. Hence, the flows of the forces of springs 3 and 11 of valve 9 and play-compensating device 8 lie on a single axis.

Depending on the design, the valve ball of check valve 18 is made of non-magnetic material in order to eliminate the effect of field forces on the compensation function.

By suitable guidance of the pressure medium (oil for example, escaping from second pressure chamber 17), all of the moving parts can be supplied with lubricating oil through appropriate bores and channels.

The two electromagnets 1 and 2 of the actuator unit are permanently connected together, but are displaceable lengthwise with respect to the valve axis. Play-compensating piston 14 is supplied with pressure medium through a pressure-medium line 21, as a function of engine oil pressure.

The embodiment shown in FIG. 1 functions as follows:

As soon as electromagnet 1 holds anchor plate 6 in the closed position, the valve play is compensated by the play-compensating device. Play-compensating device 8 then abuts sealing lid 20, permanently connected with cylinder head 7. Play-compensating device 8 can transmit only pressure forces. Retaining spring 19 is designed so that check valve 18 cannot open if there is no play. Check valve 18 thus closes the connection between the two pressure chambers 16 and 17. If the valve does not close properly, in other words, "negative" valve play is present, the pressure is increased in pressure chamber 17 as a result of the upwardly directed movement of the actuator unit. This pressure increase causes the pressure medium to escape from pressure chamber 17 through annular gap 28 as a throttle connection between play-compensating piston 14 and cylinder 15, until the play at the valve seat between valve 9 and valve seat 10 is zero.

Of course, the pressure medium can also be deliberately discharged from pressure chamber 17 through other deliberate leaks, for example recesses, a bore, or the like, instead of through annular gap 28.

If valve 9 rests correctly on valve seat ring 10 and there is play between valve shaft 13 and/or support plate 12 and the lower end of guide pin 5 at the point marked 22, play-compensating device 8 is also actuated. In this case, no pressure force acts on pressure chamber 17, so that the pressure in first pressure chamber 16 is higher, and the check valve 18 opens against the force of spring 19. In this fashion, pressure medium is added from upper first pressure chamber 16 to lower second pressure chamber 17 until the actuator unit has been pressed downward to the point where play at "22" is eliminated once more. This compensation takes place over several cycles or working cycles of the engine.

It should be noted that the embodiment of FIG. 1 shows the resting state with valve 9 in the half-open position. For this reason, there is a space between armature plate 6 and upper electromagnet 1. When electromagnet 1 attracts, closing valve 9, there is no longer any space at this point, but because of wear, manufacturing tolerances, thermal expansion, or the like, undesired play may be present at "22" or could develop there.

In this embodiment, cylinder 15 is merely inserted into a bore in electromagnet 1, so that the two parts can be shifted with respect to one another for the desired function. However, in this design, an effect develops such that the entire actuator unit moves during the "capture current time." The term "capture current time" refers to the time during which the upper magnet is actuated to close the valve.

Figure 2:
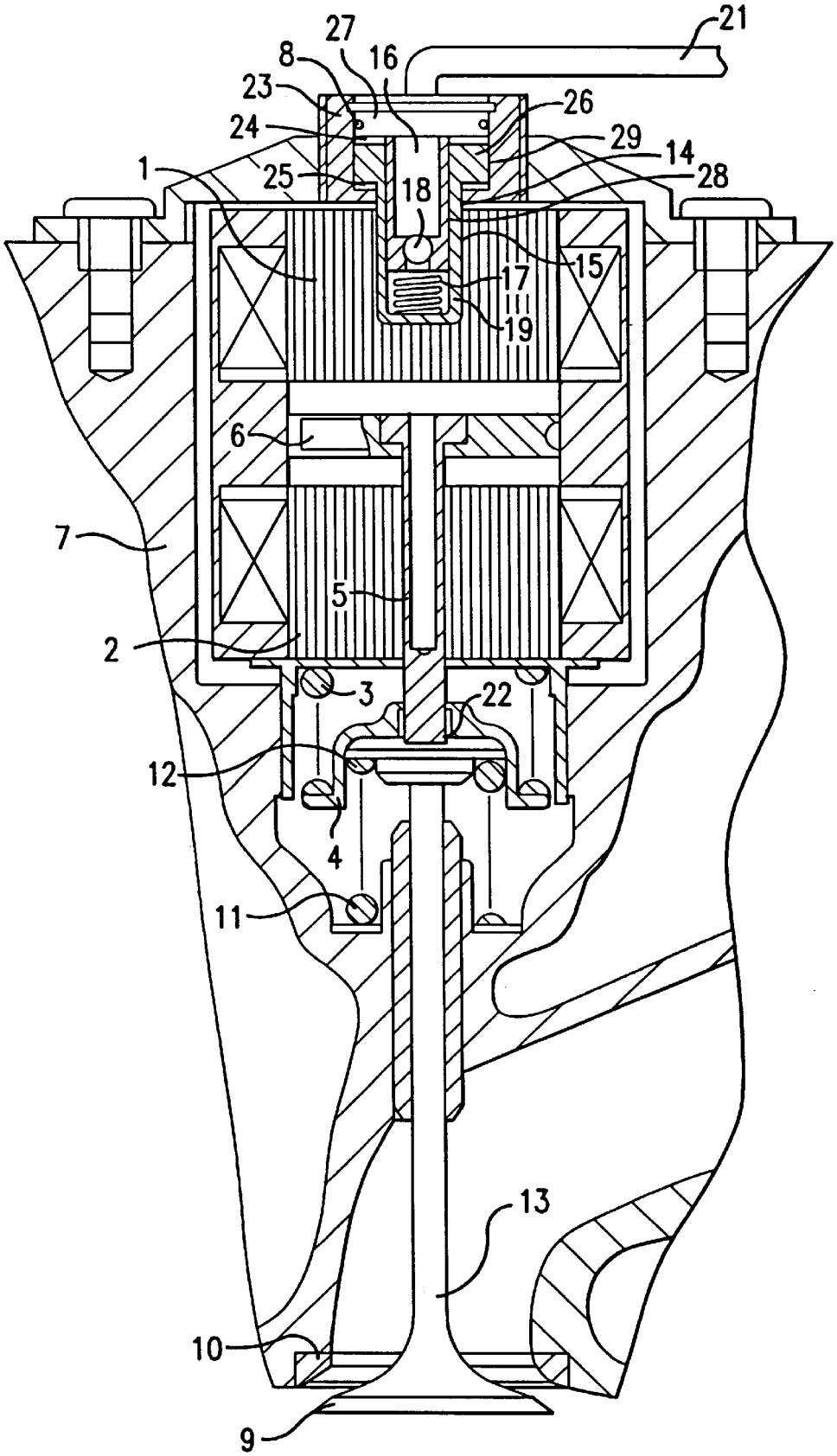
FIG. 2 is a lengthwise section through a second embodiment of the invention.

The purpose of the embodiment according to FIG. 2 is to prevent the actuator from moving during the "capture current time." Basically, the embodiment according to FIG. 2 has the same design as the one in FIG. 1, and the same reference numbers will be used below for the same parts.

In addition to the features of the embodiment in FIG. 1, play-compensating device 8 has a tensioning cylinder 23 with an upper pressure chamber 24 and a lower pressure chamber 25. Cylinder 15 has an annular expansion 26 at its upper end, which acts as a separating piston between the two pressure chambers 24 and 25. Tensioning cylinder 23 is divided into two parts by an upper lid 27, solely for assembly reasons.

As in the embodiment according to FIG. 1, a first (upper) pressure chamber 16 and a second (lower) pressure chamber 17 are provided. The same applies to check valve 18 and retaining spring 19. In this case however, cylinder 15 is permanently connected with the actuator unit (upper electromagnet 1). The annular gap between cylinder 15 and piston 14, however, does not terminate "directly" outward as in the embodiment in FIG. 1, but in upper pressure chamber 24. Likewise, deliberate leakage is permitted between upper pressure chamber 24 and lower pressure chamber 25 of cylinder 23, through an annular throttle gap 29 or through throttle grooves for example. Once again, deliberate gaps, fit with play, channels, and bores to carry the pressure medium out and away, lead out of lower pressure chamber 25, which prevents the actuator unit (and hence electromagnet 1) from moving during the "capture current time." Lower electromagnet 2 is responsible for opening valve 9 in known fashion.

The embodiment according to FIG. 2 functions as follows:

When electromagnet 1 is energized, armature plate 6 and electromagnet 1 would normally move toward one another, as in the embodiment according to FIG. 1. However, the flow of force extends from cylinder 15 to lower pressure chamber 25 and thence to the housing and cylinder head 7, so that upper electromagnet 1 cannot move and armature plate 6 moves alone toward electromagnet 1. The "capture current time" is very short. Because of the short time, no pressure medium compensation can take place between the two pressure chambers 24 and 25, and the unit therefore behaves approximately like a rigid body. Play compensation however can be performed for the entire time during which valve 9 is closed, namely for more than one engine revolution. This means that pressure compensation can take place between pressure chamber 24 and pressure chamber 25 during this time, namely by the deliberate leakage through throttle gap 29, and the pressure medium previously expelled from second pressure chamber 17 and forced through annular gap 28 between play-compensating piston 14 and cylinder 15. The pressure medium pressed in this manner into upper pressure chamber 24 is then carried away by additional deliberate leakage in throttle gap 29 into lower pressure chamber 25 and thence to the exterior. This removal of the pressure medium is possible during the entire time that valve 9 is closed, in contrast to the short time during the "capture current phase" in which hydraulic tensioning takes place as a result of the lack of pressure compensation between the two pressure chambers 24 and 25 during a short period of time. Movement of the actuator unit is possible only when sufficient time is available and negative or positive valve play is to be compensated.

In order for this embodiment to function, the leaks need only be chosen so that during a short loading ("capture current time"), the pressure medium volume flow permits approximately zero filling, while during longer loading (valve closure time) it permits filling of second pressure chamber 17 or displacement of the actuator unit and hence an exchange of pressure medium between pressure chambers 24 and 25 through annular throttle gap 29.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Device for electromagnetic actuation of a poppet valve for an internal combustion engine, said device having an actuator unit that cooperates with the poppet valve and is provided in a cylinder head of said engine, the actuator unit having an armature and two electromagnets located on either side thereof, with the electromagnets holding the poppet valve in an open and in a closed position, wherein:

the actuator unit is mounted to float in said cylinder head, with a play-compensating device being located on or in the actuator unit, which faces away from the poppet valve;

the play-compensating device has a play-compensating piston with first and second pressure chambers;

the first pressure chamber is controlled as a function of engine lubricant pressure, and the second pressure chamber is connected through a check valve with the first pressure chamber; and pressure medium can be transferred out of the second pressure chamber through a throttle connection between the play-compensating piston and a first cylinder, which surrounds the play-compensating piston.

2. Device according to claim 1, wherein the first cylinder is displaceable in the actuator unit in a lengthwise direction of the poppet valve.

3. Device according to claim 1 wherein:

the play-compensating piston is effectively connected with a tensioning cylinder, which has third and fourth pressure chambers;

the third and fourth pressure chambers tension the play-compensating piston and are filled with a pressure medium, leaving a throttle gap;

the cylinder is permanently connected with said actuator unit; and the second pressure chamber is connected through a throttle line with one of the third and fourth pressure chambers of the tensioning cylinder.

4. Device according to claim 1 wherein the play-compensating piston is located coaxially with respect to a lengthwise axis of the poppet valve.

5. Device according to claim 2 wherein the play-compensating piston is located coaxially with respect to a lengthwise axis of the poppet valve.

6. Device according to claim 3 wherein the play-compensating piston is located coaxially with respect to a lengthwise axis of the poppet valve.

7. Device according to claim 1 wherein the throttle connection is in the form of an annular gap between the play-compensating piston and the first cylinder.

8. Device according to claim 2 wherein the throttle connection is in the form of an annular gap between the play-compensating piston and the first cylinder.

9. Device according to claim 3 wherein the throttle connection is in the form of an annular gap between the play-compensating piston and the first cylinder.

10. Device according to claim 4 wherein the throttle connection is in the form of an annular gap between the play-compensating piston and the first cylinder.

11. Device according to claim 5 wherein the throttle connection is in the form of an annular gap between the play-compensating piston and the first cylinder.

12. Device according to claim 6 wherein the throttle connection is in the form of an annular gap between the play-compensating piston and the first cylinder.

13. Device according to claim 7 wherein the throttle connection is in the form of an annular gap between the play-compensating piston and the first cylinder.

* * * * *